United States Patent [19]

Burandt

[11] Patent Number: 4,683,848

[45] Date of Patent: Aug. 4, 1987

[54] APPARATUS UTILIZING A PLURAL-PROFILED CAM UNIT FOR ACTUATING THE VALVE OF AN INTERNAL COMBUSTION ENGINE

[75] Inventor: Corliss O. Burandt, Plymouth, Minn.

[73] Assignee: Investment Rarities, Incorporated, Minneapolis, Minn.

[21] Appl. No.: 595,302

[22] Filed: Mar. 30, 1984

Related U.S. Application Data

[63] Continuation of Ser. No. 378,842, May 17, 1982, abandoned.

[51] Int. Cl.[4] ..... F01L 1/18

[52] U.S. Cl. ..... 123/90.6; 123/90.44; 74/567

[58] Field of Search ..... 123/90.4, 90.6, 90.17, 123/90.21, 90.31, 90.39, 90.41, 90.44, 90.45, 90.16; 74/567

[56] References Cited

U.S. PATENT DOCUMENTS

| | | | |
|---|---|---|---|
| 862,448 | 8/1907 | Cornilleau | 123/90.18 |
| 920,417 | 5/1909 | Berliet | 123/90.18 |
| 925,528 | 6/1909 | Sweet | 123/90.18 |
| 992,089 | 5/1911 | Watt | 123/90.18 |
| 997,253 | 7/1911 | Hesselman | 123/90.18 |
| 1,223,762 | 4/1917 | Bugatti | 123/90.22 |
| 1,415,793 | 5/1922 | Cattaneo | 123/90.27 |
| 1,737,316 | 11/1929 | Manning | 123/90.45 |
| 1,757,046 | 5/1930 | Horine | 123/90.18 |
| 2,804,863 | 9/1957 | Bensinger et al. | 123/90.6 |
| 2,817,326 | 12/1957 | Taylor | 123/90.27 |
| 2,863,432 | 12/1958 | O'Brien | 123/90.27 |
| 3,523,465 | 8/1970 | Harrell | 123/90.18 |
| 4,084,568 | 4/1978 | Sato et al. | 123/90.6 |
| 4,401,069 | 8/1983 | Foley | 123/90.18 |
| 4,484,546 | 11/1984 | Burandt | 123/90.27 |

FOREIGN PATENT DOCUMENTS

| | | | |
|---|---|---|---|
| 175743 | 8/1953 | Fed. Rep. of Germany | 123/90.6 |
| 2921645 | 12/1980 | Fed. Rep. of Germany | 123/90.17 |
| 497370 | 3/1919 | France | 123/90.6 |
| 527918 | 11/1921 | France | 123/90.6 |
| 1109790 | 9/1955 | France | 123/90.17 |
| 1083074 | 11/1955 | France | 123/90.27 |
| 2484019 | 12/1981 | France | 123/90.6 |
| 46044 | 3/1980 | Japan | 123/90.6 |
| 21823 | of 1912 | United Kingdom | 123/90.6 |
| 16444 | of 1913 | United Kingdom | 123/90.6 |

*Primary Examiner*—Craig R. Feinberg
*Assistant Examiner*—David A. Okonsky
*Attorney, Agent, or Firm*—Peterson, Wicks Nemer & Kamrath

[57] ABSTRACT

A cam unit comprised of at least two side-by-side cams acts against a follower rocker arm that operates either an intake or exhaust valve of an internal combustion engine. One cam is formed with sloping take-up ramp portions connecting with a lobe portion. The side-by-side cam (or cams) has a base circle portion that increases in diameter to form sloping take-up ramp portions connecting with an eccentric portion slightly larger in radius than the base circle portion. The lobe portion on the one cam projects a radial distance considerably greater than the eccentric portion (or portions). Different working surfaces on the follower arm are thus engaged by the cams to reduce erosion.

11 Claims, 7 Drawing Figures

APPARATUS UTILIZING A PLURAL-PROFILED CAM UNIT FOR ACTUATING THE VALVE OF AN INTERNAL COMBUSTION ENGINE

CROSS-REFERENCE TO RELATED APPLICATION

This application is a continuation of application Ser. No. 378,842, filed May 17, 1982, and now abandoned for "Apparatus Utilizing a Plural-Profiled Cam Unit for Actuating the Valve of an Internal Combustion Engine".

BACKGROUND OF THE INVENTION

1. Field of the Invention

This invention relates generally to apparatus for actuating the intake and/or exhaust valves of an internal combustion engine, and pertains more especially to apparatus employing a specially configured cam unit for providing a relatively quiet valve operation that does not require frequent lash adjustments.

2. Description of the Prior Art

Generally, valves, whether they be intake or exhaust valves, have usually been opened and closed through the agency of rocker arms, there being one for each intake valve and another for each exhaust valve. The rocker arms, when pivoted by the particular cam associated therewith, will cause the rocker arm to bear against the upper end of the valve member, more specificially against a lash cap, to cause the valve to open. This entails the overcoming of a spring action that normally closes the valve but yields when the particular cam for that valve acts against the rocker arm in a manner to force the valve open against the action of the spring. In some cases, there are vertical pushrods extending upwardly from the cams that bear against one end of a rocker arm in each instance. In less encountered situations, the cams bear directly against the lash caps to cause the valves to open.

Irrespective of which design is employed, there is a certain amount of wear that occurs between the cams and the rocker arms, or the cams and the lash caps when the cams act directly on the lash caps. A significant proportion of the wear results from a single cam constantly bearing against the same follower surface durings its entire rotation, whether the follower surface be part of a rocker arm or a lash cap. Such continuous and repetitious engagement of the cam lobe against the follower laterally wears a groove in the follower's working surface. As the groove becomes deeper and deeper, the erosive action, the clearance between the cam's base circle and the bottom of the constantly deepening groove increases; hence, the increase in lash.

It is the progressive increase in lash that requires rather frequent adjustments, usually by adding shims between the lash cap and end of the valve stem. As the amount of lash increases, however, the valve noise increases. Consequently, the solution to the problem of increasing lash has at times been met by using hydraulic valve lifters. Hydraulic valve lifters, however, are more costly, and require heavier springs to seat the valves when hydraulic lifters are employed because the springs must exert a greater amount of closing force in order to overcome the hydraulic pressure on the lifter. When the spring constant or strength is increased, then more power is needed to open the valves.

SUMMARY OF THE INVENTION

A broad object of my invention is to minimize any increase in lash, thereby requiring less frequent lash adjustments than heretofore. It will be recognized that the usual procedure is to check the amount of increased clearance, and then add shims of appropriate thickness beneath the lash caps.

Since increased lash results in a noisier valve operation, another object closely allied to the above object is to provide a quieter valve operation than that which would result with conventional valve operating arrangements that are not hydraulic and that are not timely adjusted to compensate for increased lash.

Still another object is to avoid the need for using more expensive valve lifters, yet achieving the quiet valve operation that hydraulic lifters provide. In this regard, it is an aim to avoid having to employ heavier springs that hydraulic lifters require and the increased power to actuate valves equipped with such heavier springs.

Also, an object is to provide a cam unit that achieves the above objects which may possess the same profile configuration for both the intake and the exhaust valves of an internal combustion engine.

Briefly, my invention contemplates the employment of a cam unit that is composed of at least two side-by-side cams. In this regard, one cam has a base circle portion that increases in diameter to form sloping take-up ramps connecting with an eccentric portion slightly larger in radius than the base circle portion. Preferably two such cams are utilized. When two such cams are used, there is an intermediate cam that has a base circle corresponding in radius to that of the other two cams. In order to force the valve open, and this is so with respect to either intake or exhaust valves, the intermediate cam is formed with sloping take-up ramps connecting with a lobe portion that projects a radial distance considerably beyond that of the eccentric portion. The lobe portion, which is integral with the intermediate cam, is radially aligned with the eccentric portion on the two flanking or outer identical cams.

Stated somewhat differently, the base circle portions of the three cams will normally be situated above the follower surface, which follower surface is usually the upper side of a rocker arm, and as the cam unit rotates, the ramp portions take up the clearance or lash in preparation for the lobe portion to then act in a direction to force the valve open. The lobe portion of the intermediate or central cam bears against a different working or follower surface portion that is situated in between the surfaces against which the base circle portions of outer or flanking cams engage. Since the lobe portion, which determines the lift or degree of valve opening, has a relatively great slope or inclination, it will be appreciated that the wear is greater per unit length of engagement than if the slope were less pronounced. With prior art cams, the base circle, the ramps and lobe are all on a single cam. Hence, the erosive grooving that occurs is where the lobe engages the follower surface producing a groove that adversely affects the lash. My invention divorces the base circle and lash take-up ramps from the cam lobe by utilizing appropriately configured additional cam means providing lash take-up by the additional cam means on surface portions of the follower means, usually a rocker arm, not engaged by the valve lifting cam lobe.

DESCRIPTION OF THE PREFERRED EMBODIMENT

Figure 1:
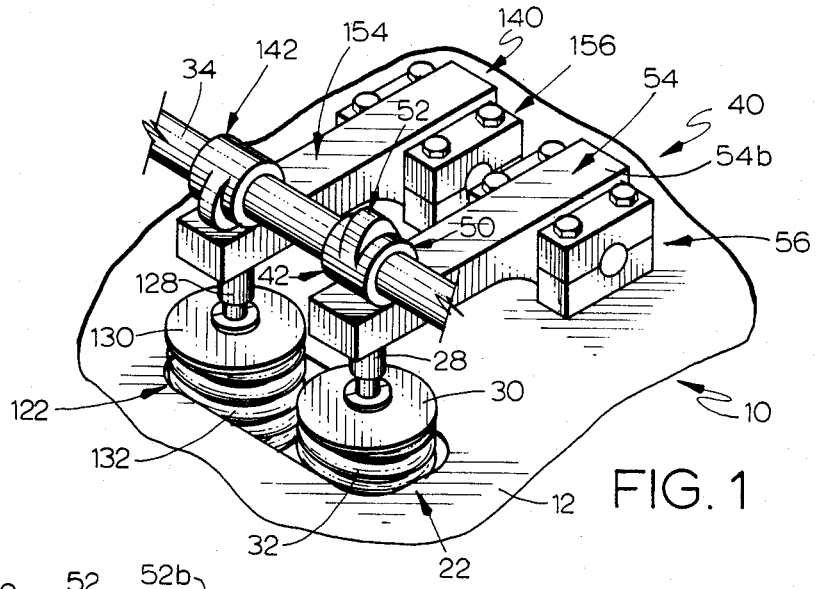
FIG. 1 is a diagrammatic perspective view illustrating my valve actuating apparatus when used for both intake and exhaust valves of an internal combustion engine.
Figure 2:
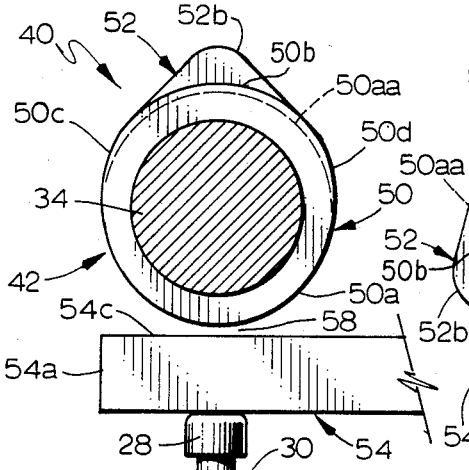
FIG. 2 is an enlarged sectional view through the camshaft of FIG. 1, the view being taken just to the right of the intake valve cam unit.
Figure 3:
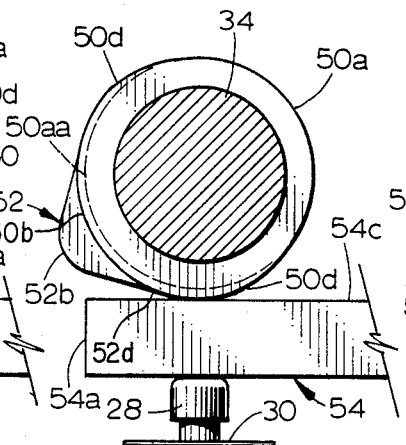
FIG. 3 is a view corresponding to FIG. 2 but with the cam unit rotated so that the clearance or lash present in FIG. 2 has been taken up.
Figure 4:
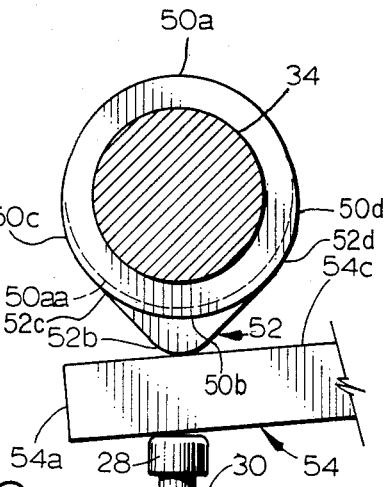
FIG. 4 is still another view similar to FIG. 2 but with the cam lobe advanced to a position in which the intake valve is fully open.

With initial reference to FIG. 1 of the drawings, a conventional internal combustion engine 10 has been fragmentarily pictured, even fewer fragments of the engine 10 appearing in FIGS. 2–4 than in FIG. 1. The engine 10 includes a cylinder block having a cylinder head 12 with a combustion chamber or cylinder at 14; it will be appreciated that the cylinder 14, the walls of which have been omitted for reasons of drafting simplicity, is just one of a plurality of such cylinders. As can be discerned from FIGS. 2, 3 and 4, there is an intake valve port 18 having a passage 20 in fluid communication with the intake manifold (not illustrated) of the engine 10.

Inasmuch as FIGS. 2, 3 and 4 are rather arbitrarily concerned with the intake port 18, it can be explained that a conventionally designed intake valve is located generally at 22 in FIG. 1. More specifically, the intake valve 22 includes a head 24 having a beveled surface that effectively closes the intake port 18 when the valve has moved sufficiently upwardly. Still further, the valve 22 comprises a stem 26 having a lash cap 28 mounted at its upper end; the lash cap 28 can be raised or lowered on the valve stem 26 by means of small shims of appropriate thickness placed between the upper end of the valve stem 26 and the cap 28. As is typical, a retainer 30 holds a coil spring 32 captive so that the head 24 of the valve 22 is biased or urged upwardly into a closed or seated position when the valve 22 is not forced open.

At this stage, it should be appreciated that the present invention can be equally used in conjunction with an exhaust valve located generally at 122 in FIG. 1. Inasmuch as the exhaust valve 122, for all intents and purposes, is identical in construction to the intake valve 22, no need exists for further describing the exhaust valve 122 other than to say that it is biased into a closed position through the agency of a coil spring 132 acting against a retainer 130.

A camshaft 34 is employed, this camshaft 34 being connected, such as by a chain (not shown), to the crankshaft of the engine 10. The camshaft 34, through the agency of the chain, is driven by the crankshaft at half the speed of the crankshaft, which is conventional in a four-cycle engine.

As already indicated, the cylinder walls for the combustion chamber cylinder 14 have not been shown; likewise, the piston associated with the cylinder 14 has not been illustrated. It will be understood, though, that in a four-cycle internal combustion engine, such as the engine 10, there will be four strokes of the piston in order to provide a complete cycle of operation. Thus, during the first stroke, the piston moves downwardly within the cylinder 14 to the bottom of the cylinder. The intake valve 22 is open during this time, but the exhaust valve 122 is, quite obviously, closed. It is during the intake stroke or downward movement of the piston that a charge of fuel and air is inducted into the cylinder 14 through the port 18, the charge being pulled through the previously mentioned passage 20 connecting with the undisclosed intake manifold.

At the end of the intake stroke, the intake valve 22 and the exhaust valve 122 would be closed and the piston starts to move upwardly to compress the mixed fuel and air that has been drawn into the cylinder. Near the top of the so-called compression stroke, the charge is ignited by means of a spark produced by the spark plug (also not shown). Next, the piston moves downwardly, this stroke being termed the power stroke. When the piston reaches the bottom of the cylinder on the power stroke, the exhaust valve 122 is opened with the intake valve 22 remaining closed. The piston then advances upwardly, which is called the exhaust stroke, to move the exhaust gases from the cylinder 14. After the exhaust gases have been forced out, the exhaust valve 122 is again closed and the intake valve 22 is opened to initiate another operational cycle.

What has been described above has been concerned with the construction and operation of a conventional engine 10. The foregoing description should, however, be of benefit in facilitating an appreciation of my valve actuating apparatus, which has been denoted generally by the reference numeral 40 when used in conjunction with the intake valve 22 and 140 for the exhaust valve 122. The apparatus 40, the apparatus 140 being identical thereto, includes a cam unit 42 that is specially configured in order to minimize lash increase. The cam unit 42, it will be noted, is fixedly mounted on the camshaft 34 for rotation therewith in the same manner that cams in the past have been secured to their camshafts.

In the illustrative case, the cam unit 42 is comprised of what will be termed three integral cams 44, 46 and 48. However, the unit 42 may be considered to be a single cam 42, and when so considered it would have three cam portions 44, 46, and 48. The outer two cams 44, 46 have identical profiles, the profiles being generally indicated by the reference numeral 50. More specifically, though, each profile 50 includes a base circle portion **50*a* and an eccentric circle portion 50*b*, each subtending an arc approximately 180°. The portions 50*c*, 50*d*, between the base circle portion 50*a* and the eccentric portion 50*b***, serve as take-up ramps, extending only over a few camshaft degrees.

The centrally disposed cam 48 of the unit 42 has a profile 52 which includes a base circle portion **52*a* of the same radius as the base circle portion 50*a* for the two outer cams 44, 46. The base circle portion 52*a* in this instance subtends an arc corresponding to that of the base circle portion 50*a* and leading into a lobe portion 52*b* spanning the same arc as the eccentric portion 50*b*, there being ramp portions 52*c*, 52*d* therebetween. It will be readily apparent that the lobe portion 52*b* projects radially a much greater distance than does the eccentric portion 50***b*. Also, it is to be noted that the lobe portion 52*b* is radially aligned with the center of the eccentric portion 50*b*. The base circle portion 50*a* has been continued in phantom outline for the entire periphery or circumference of the two cams 44, 46, this being evident from FIGS. 2, 3 and 4, the extended base circle portion being labeled 50*aa*.

The rocker arm for the intake valve 22 has been assigned the reference numeral 54. The rocker arm for the exhaust valve 122, which is identical to the arm 54, has been given the reference numeral 154. Whereas the free end 54*a* of the rocker arm 54 bears directly against the lash cap 28 of the intake valve 22, the other end 54*b* is pivotally mounted in a bearing assembly denoted generally by the reference numeral 56. The flat working or follower surface against which the cam unit 42 engages has been denoted by the reference numeral 54*a*, extending between the ends 54*c* and 54*b*. In like fashion, the rocker arm 154 for the exhaust valve 122 is mounted in a bearing assembly 156. It will be understood that the rocker arms 54 and 154 may assume other shapes.

Figure 5:
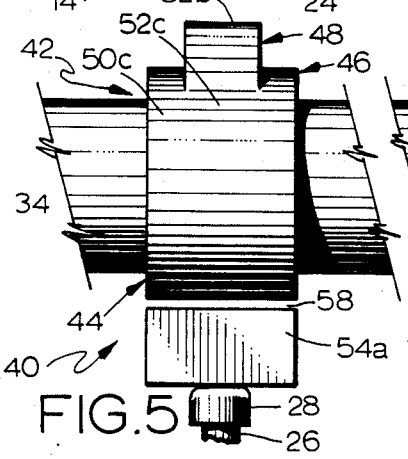
FIG. 5 is an end elevational view taken from the left in FIG. 2.

The manner in which my apparatus 40 functions should be readily understandable from the information hereinbefore given. In FIGS. 2 and 5, though, it will be observed that there is no contact or engagement between the cam unit 42 and the upper or working surface 54*c* of the rocker arm 54 therebeneath.

Figure 6:
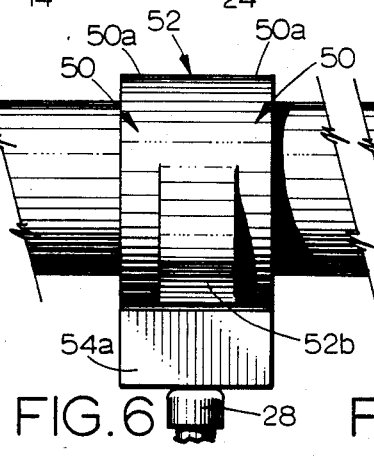
FIG. 6 is an end elevational view taken from the left in FIG. 3.

As the cam unit 42 rotates in a counterclockwise direction, such rotation eliminates the clearance 58 shown in FIGS. 2 and 5. Thus, the clearance 58 is taken up in FIGS. 3 and 6 by reason of the ramp portions 50*c* and 52*c* connecting the base circle portions 50*a* and 52*a* to the eccentric and lobe portions 50*b* and 52*b*, respectively, when these portions 50*c* and 52*c* rotate into contact or engagement with the flat working surface 54*c* of the rocker arm 54, as depicted in FIGS. 3 and 6. In other words, the cam unit 42 has rotated in a counterclockwise direction from the position in which it appears in FIG. 2 into the position in which it is shown in FIG. 3 to take up the clearance 58. At this point, the valve is still closed, for only the clearance 58 between the base circle portions 50*a*, 52*a* and the follower or working surface 54*c* on the rocker arm 54 has been eliminated.

Figure 7:
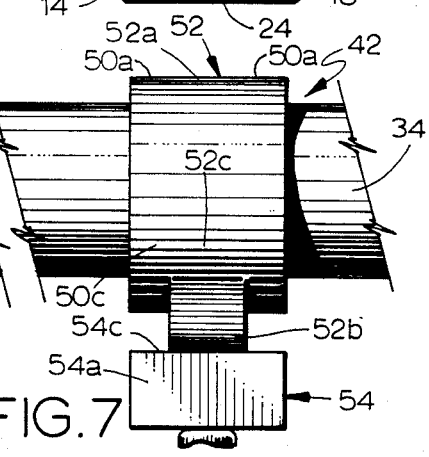
FIG. 7 is an end elevational view taken from the left in FIG. 4.

It is the movement or rotation of the cam unit 42 from the rotated position appearing in FIGS. 3 and 6 to that pictured in FIGS. 4 and 7 that causes the valve 22 to open. The lift or amount of valve opening is determined by the lobe portion 52*b*. By having the radius of the lobe portion 52*b* sufficiently greater than that of the eccentric portion 50*b*, the difference between the two radii determines the extent that the valve 22 is pushed open. Thus, shortly after the ramp portions 50*c* and 52*c* have engaged the upper surface 54*c* of the rocker arm 54, as in FIGS. 3 and 6, continued rotation of the cam unit 42 in a counterclockwise direction from FIG. 3 to FIG. 4 will cause the lobe portion 52*b* to be progressively more effective, the lobe portion 52*b* forcing the valve 22 downwardly into its fully open position as seen in FIGS. 4 and 7.

From the above it will be recognized that there is successive engagement of the portions 50*a* and 52*a*, the portions 50*c* and 52*c*, the portion 52*b* and the portions 50*d* and 52*d* with the follower surface 54*c*. The repeated engagement of the lobe portion 52*b*, owing to the pronounced slope thereof, will, over a period of time, wear a groove in the working surface 54*c* of the rocker arm 54. Hence, the clearance between the base circle portion 52*a* and the bottom of the groove resulting from the erosive action of the lobe portion 52*b* increases because the groove gets progressively deeper. In the past any such increase in lash would be compensated for by adding shims of appropriate thickness between the upper end.

However, by shifting the lash take-up function from the cam 48 to the cams 44 and 46, the ramp portions 50*c* and 50*d* bear against different areas of the working surface 54*c* from the cam 48, more specifically its lobe portion 52*b*. Since the ramp portions 50*c* and 50*d* of the cams 44 and 46 have a far less slope than the lobe portion 52*b*, the wear against laterally spaced areas of the follower or working surface 54*c* of the rocker arm 54 is relatively insignificant compared to that of the groove-producing lobe portion 52*b* that repeatedly engages the area between the laterally spaced areas just mentioned.

As a result of the above, the effective clearance 58 between the base circle portions 50*a* and the surface 54*c* remains virtually unchanged. Hence, by adjusting the initial lash so that the ramp portions 50*c* and 50*d* just take-up the clearance 58 when moving from the position of FIG. 2 to FIG. 3, the need for further lash adjustment is indeed very infrequent. With but minimal change in lash, the valve noise is kept to a minimum also.

My apparatus 40 (or 140) makes hydraulic lifters unnecessary, which lifters are comparatively expensive to the solid-type of lash cap 28. Also, the need for heavier springs 32 to overcome the amount of hydraulic pressure added by hydraulic lifters is eliminated along with the avoidance of a power increase just to effect a seating of valves when equipped with stronger springs.

I claim:

1. Apparatus for operating a reciprocable valve assembly associated with a combustion cylinder of an internal combustion engine comprising an axially-fixed camshaft having a central axis, first cam means mounted on said camshaft for rotation therewith, said first cam means having a first base circle portion, and first and second ramp portions, said first ramp portion being connected at one end of said first base circle portion and extending in one direction away from said first base circle portion and gradually increasing in radius in said one direction, said second ramp portion being connected at one end to said first base circle portion and extending in an opposite direction away from said first base circle portion and gradually increasing in radius in said opposite direction, second cam means having a second base circle portion of the same radius as said first base circle portion, a lobe portion radially extending from said central axis a first distance and connecting third and fourth ramp portions, said third ramp portion extending in said one direction away from said second base circle portion and gradually increasing in radius in said one direction, said fourth ramp portion extending in said opposite direction away from said second base circle portion and gradually increasing in radius in said opposite direction, said first cam means having an outermost radial distance less than said first distance and follower means providing a single working surface engageable by both of said first and second cam means, said lobe portion and the third and fourth ramp portions of said second cam means engaging a different portion of the single working surface of said follower means from that engaged by the first and second ramp portions of said first cam means.

2. Apparatus for operating a reciprocable valve assembly in accordance with claim 1 including an eccentric portion between said first and second ramp portions connected to the other ends of said first and second ramp portions, said first ramp portion gradually increasing in radius to said eccentric portion and said second ramp portion gradually decreasing in radius from said eccentric portion, and in which said lobe portion and said eccentric portion each have an apex lying in a common plane which plane includes the axis of said camshaft.

3. Apparatus for operating a reciprocable valve assembly associated with a combustion chamber of an internal combustion engine comprising cam follower means for acting only against said valve assembly and having only a single working surface, first cam means rotatable about a given axis having a base circle portion providing clearance between said single working surface of said cam follower means when said first cam means is in one rotative position and having ramp portions, said ramp portions being connected to said base circle portion and sloping radially outward in opposite directions from said base circle portion, and radially outward with respect to said axis, a sufficient distance to take-up said clearance when said first cam means is in a second rotative position, said ramp portions of said first cam means engaging said single working surface of said cam follower means in said second rotative position as said first cam means rotates about said axis, second cam means rotatable about said axis, said second rotatable cam means being adjacent said first cam means and having a base circle portion of the same radius as that of the base circle portion of said first cam means and providing the same clearance between said single working surface of said cam follower means when said second cam means is in the same one rotative position as said first cam means and having a lobe portion, said lobe portion of said second cam means extending a greater distance from said axis than said ramp portions of said first cam means extend from said axis and said lobe portion engaging a different portion of said single working surface of said cam follower means than that engaged by the base circle portion and the ramp portions of said first cam means as said first and second cam means rotate.

4. Apparatus for operating a reciprocable valve assembly in accordance with claim 3 in which said first and second cam means constitute a single cam unit, both of which cam means engage the same follower means for actuating said valve assembly.

5. Apparatus for operating a reciprocable valve assembly in accordance with claim 4 including a camshaft, said cam unit being mounted on said camshaft.

6. Apparatus for operating a reciprocable valve assembly in accordance with claim 3 in which said first cam means includes a pair of identical cams, each having a base circle portion and ramp portions, and in which said second cam means includes a single cam having said base circle and lobe portion thereon, said second cam means also having ramp portions sloping radially outward in opposite directions from the base circle portion of said second cam means to said lobe portion at said same sufficient distance to take-up said clearance when said second cam means is in the same said second rotative position as said first cam means.

7. Apparatus for operating a reciprocable valve assembly in accordance with claim 6 in which said follower means includes a single rocker arm mounted at one end for pivotal movement about an axis spaced from said valve assembly and having its other end acting against said valve assembly.

8. Apparatus for operating a reciprocable valve assembly in accordance with claim 7 in which said valve assembly includes a valve head, a stem and a lash cap, said rocker arm acting against said lash cap.

9. Apparatus for operating a reciprocable valve assembly in accordance with claim 7 in which the base circle portion and the ramp portions on said pair of cams each engage differently laterally spaced portions of said rocker arm and the base circle portion and the lobe portion of said single cam engage still a different portion of said single rocker arm between said laterally spaced portions, the portion of said rocker arm engaged by the base circle portion and the lobe portion on said single cam constituting said still different portion.

10. Apparatus for opening a reciprocable valve assembly associated with a combustion cylinder of an internal combustion engine comprising an axially-fixed camshaft, first cam means mounted on said camshaft for rotation therewith, said first cam means having a base circle portion, an eccentric portion, and connecting first and second ramp portions, second cam means mounted on said camshaft for rotation therewith, said second cam means having a base circle portion, a lobe portion and connecting first and second ramp portions, the base circle portions of both of said cam means having equal radii, the first ramp portions of both of said cam means increasing in radius from their respective base circle portions to the same extent until they reach alignment with the beginning of said lobe portion, and the second ramp portions of both of said cam means increasing in radius from their respective base circle portions to the same extent until they reach alignment with the ending of said lobe portion, and unitary follower means having a single working surface engageable by both of said cam means, the base circle portions of both of said cam means and said single working surface of said follower means having a mount of radial clearance therebetween and said first and second ramp portions of said first cam means substantially reducing said relatively small amount of clearance when successively engaging one portion of said single working surface of said unitary follower means, said lobe portion engaging a different portion of said single working surface of said unitary follower means from that engaged by the first and second ramp portions of said first cam to cause opening of said valve assembly.

11. Apparatus for operating a reciprocable valve assembly in accordance with claim 10 in which said lobe portion and said eccentric portion each have an apex lying in a common plane which plane includes the axis of said camshaft and are centrally located with respect to both of said first ramp portions and both of said second ramp portions, respectively.

* * * * *